US005653642A

United States Patent [19]

Bonacorsi

[11] Patent Number: 5,653,642

[45] Date of Patent: Aug. 5, 1997

[54] GOLFING GAME

[75] Inventor: Jimmy Bonacorsi, P.O. Box 5487, San Mateo, Calif. 94403

[73] Assignee: Jimmy Bonacorsi, Hillsborough, Calif.

[21] Appl. No.: 541,415

[22] Filed: Oct. 10, 1995

[51] Int. Cl.[6] ..... A63B 69/36

[52] U.S. Cl. ..... 473/153

[58] Field of Search ..... 473/153, 351

[56] References Cited

U.S. PATENT DOCUMENTS

| | | | |
|---|---|---|---|
| 2,701,140 | 2/1955 | Fortino | 473/153 |
| 3,104,879 | 9/1963 | Jetton | 473/153 |
| 4,201,384 | 5/1980 | Barber | 473/351 X |
| 5,370,389 | 12/1994 | Reising | 473/153 |
| 5,439,224 | 8/1995 | Bertoncino | 473/153 |
| 5,445,374 | 8/1995 | Clark, Jr. | 473/153 X |
| 5,513,841 | 5/1996 | Takagi | 473/153 X |

*Primary Examiner*—William H. Grieb
*Attorney, Agent, or Firm*—Douglas A. Chaikin

[57] ABSTRACT

Disclosed herein is a golfing game and the apparatus for accomplishing the same. The game apparatus includes a driving range having a tee area and a target or series of targets. Using all the skill he possess, the player(s) strike(s) the ball toward the target(s) attempting to reach the target on one stroke. Upon reaching the target in one stroke a verification system signals the validity of the ball entering the target. After the ball entering the target is declared valid, a notification is activated which alerts the other players and personnel on the driving range. Immediately, thereafter the winning player is provided with additional rewards.

15 Claims, 3 Drawing Sheets

GOLFING GAME

BACKGROUND OF THE INVENTION

1. Field of the Invention

This invention relates generally to a game of skill and more particularly to a game of golfing skill. Even more particularly this invention relates to a golfing game which includes the use of a particularly designated golf ball and a driving range.

2. Previous Art

Throughout the history of golf there has been a need to simulate the playing of the game of golf to improve one's skill. Very often a player is unable to play 18 or even 9 holes because of the unavailability of time or a course to play or even the financial resources to play. Thus, for many years, for almost as long as golf has existed, there have been practice areas for hitting balls. These areas have commonly become known as driving ranges.

There is a long felt need to practice before and even after playing to improve one's game. The late, great Ben Hogan espoused this philosophy often and was rewarded as one of the great master's of the game of golf. Ben Hogan possessed one of the all time great golf swings, the basic building block of golf. Mr. Hogan would often practice hitting balls on a driving range until his hands hurt and even bled. Mr. Hogan often attributed his golfing success to such practice and advised amateurs to follow a similar routine.

While practicing on a driving range is of great advantage to a player trying to improve his game, it may also seem tedious and boring to some. Additionally, many who practice on the driving range are often disappointed when they take their game on the golf course. While the practice range offers a great opportunity to work on one's game, there is none of the pressure involved in scoring as there is on the actual golf course itself, whether or not a player plays in a tournament.

According to touring professionals, one of the biggest mistakes amateur golfers make is not being accurate with their approach to the green. Very often an amateur will leave his ball short of the green. Less often, but still typical of the amateur, they will push or pull their approach shot into a bunker or other hazard. Overall the chief impediment for the amateur golfer to improve his game is accuracy in his approach shots to the green. What is needed is a golfing game which offers golfers of all skill levels an opportunity to improve their game by practicing their approach shots to the green under a simulated pressure of the golfing game.

What is also needed is a golfing game designed to make hitting practice balls fun and to provide such a game that delivers a relatively immediate reward to the player. In order to facilitate all of the above, what is needed is such a game which can be complete in itself and independent of a player's golfing game, while still providing rewards commensurate with the skill level of the game of golf. What is additionally needed is for this self contained golf game to stimulate the player's interest in golf and sharpen his skills for the actual game of golf.

SUMMARY OF THE INVENTION

It is an object of this invention to provide a golfing game and apparatus which is easily understood and played by golfers of all skill levels.

It is a further object of this invention to provide such a golfing game and an apparatus for playing same which can work effectively, with relatively minor changes, with existing golf equipment and more particularly a driving range.

It is a further object of this invention to provide a game of skill which encourages a player to sharpen his golfing skills.

In accordance with the above objects and those that will be mentioned and will become apparent below, the golfing game in accordance with this invention comprises the steps of:

providing the player with a special golf ball, a driving range having a starting point and a target, a notification system and means for activating the notification system;

placing the special golf ball at the starting position a predetermined distance from the designated target;

striking the special golf ball in the direction of the target;

designating a winner for each golf ball that reaches the target in one stroke using the notification system which by activation means upon the target being reached; and providing a reward upon the activation of the notification system, whereby when the target is reached the notification system is activated and the reward provided.

In a preferred embodiment of the golfing game in accordance with this invention includes the notification system having a verification system. The verification system validates that the winning player is in fact the correct player.

The verification system includes, in a preferred embodiment, a mass verification device and a optical reader device. In this preferred embodiment, the special ball has a unique mass, unique to all special balls. The mass verification device accurately reads the mass of the special ball and verifies that it is in fact one of the special balls.

In the same or an independent preferred embodiment, the special ball has an identification code completely unique to the individual special ball. No other special ball has this unique identification code. An optical reader is provided which recognizes this unique identification code and verifies that it is a valid special ball.

In either or both of the above embodiments, the devices are electronically connected to an on-site pro-shop where the personnel in attendance can also manually verify the validity of the special ball reaching its goal. After verification, the notification system can then be activated. The notification system in one embodiment includes an electronic display at the pro shop and a large display adjacent the driving range.

An additional preferred embodiment includes the special ball being a gold color or a striped color. The paint provided on the ball will be sufficient to change the overall mass of the ball. The paint is provided to the correct amount and degree to place the mass of the special ball in the range appropriate for such special balls.

It is an advantage of this invention to a provide a self contained golfing game which is both fun and easy to understand and provides an opportunity for a player to practice his golfing skill.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
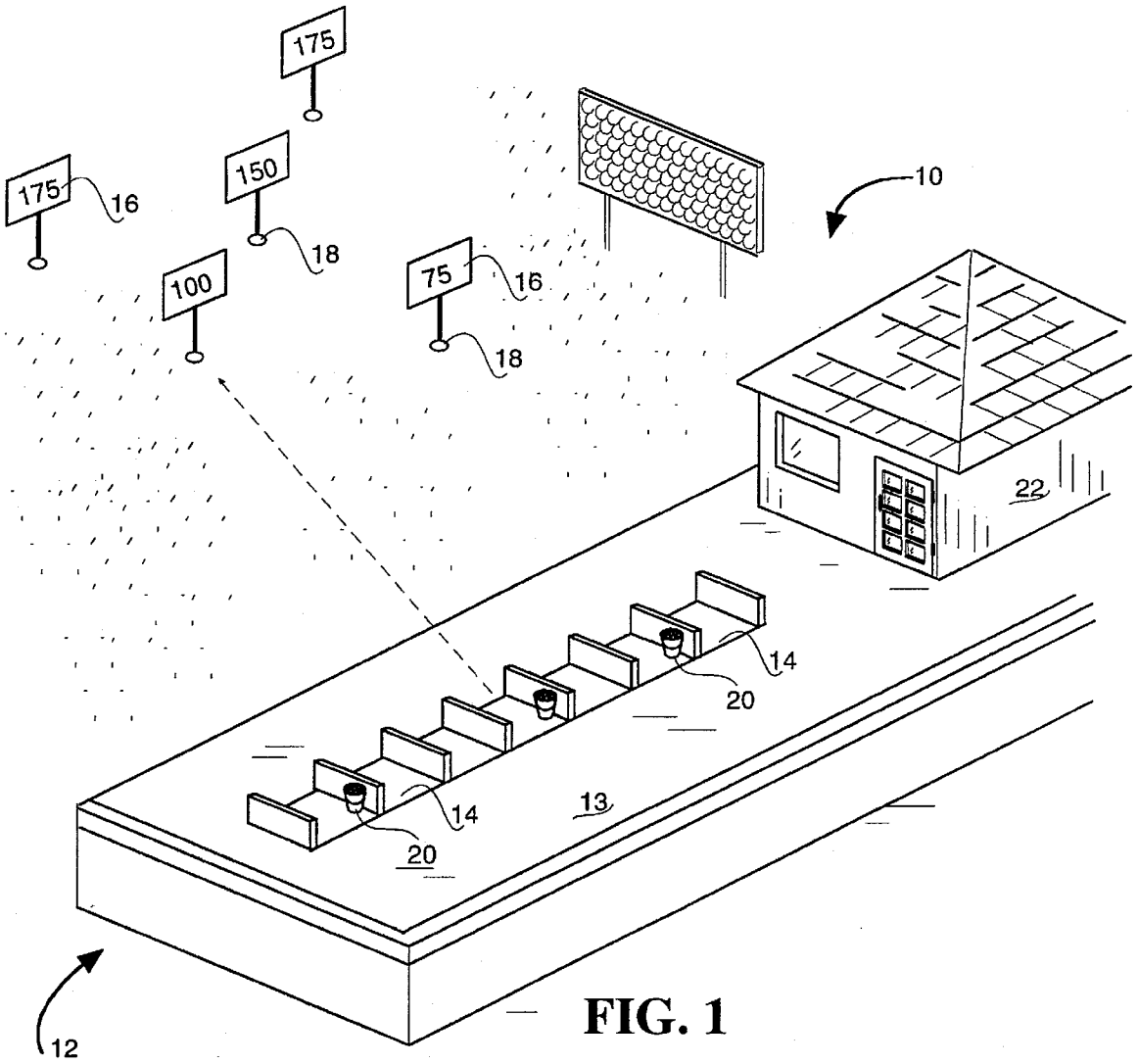
FIG. 1 is a perspective view of a driving range having various targets suitable for employing a preferred embodiment of a golfing game in accordance with this invention.

The invention will now be described with respect to FIG. 1, which illustrates a preferred embodiment of the invention shown generally by the numeral 10. The golfing game in accordance with can be played on a driving range such as that illustrated generally by the numeral 12. The driving range 12 includes a tee 13 having a plurality of tee boxes 14 and a plurality of targets 16. A player(s) stands at one of the tee boxes 14 and strikes the ball toward one of the targets 16.

As illustrated in the drawing, the starting position of the game is the tee box 14. The targets 16 comprise an individual or a series of holes 18. In one embodiment of the game, a player attempts to put a golf ball in the hole 18 which is a predetermined distance from the tee box 14. In another embodiment of the golfing game in accordance with this invention, the player must hit a series of balls into a series of holes 18, either in an order predetermined by the management of the driving range or randomly, depending upon the rules of the particular game. It will be appreciated that a virtual infinity of game variations are possible within the spirit and scope of the invention as set forth in the claims and therefore applicant herein is not to be limited by this description but only by the claims.

In one embodiment of the invention, a player purchases a bucket of balls 20 from the attendant at the pro-shop 22 adjacent the driving range 12. In each bucket of balls 20 purchased by the player, there is contained a special ball 30, such as that illustrated in FIG. 5. It will of course be appreciated that the game may include the rule where a player purchases this special ball or may even be able to purchase a series of special balls 30.

Figure 5:
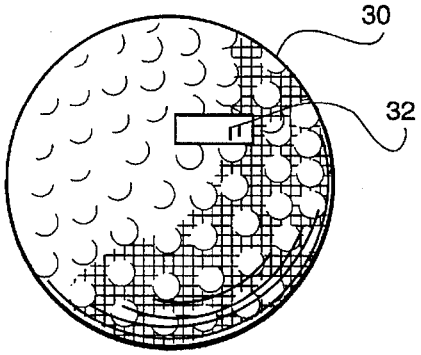
FIG. 5 is a perspective view of an example of one of the special balls used to play the golfing game in accordance with the invention.

In the embodiment shown in FIG. 5, this special ball 30 is colored gold and has a unique identification code 32. In addition to its gold color, the ball has a mass which is non-standard and unique to itself. Additionally, as set forth above the ball has its own identification number 32. The identification number is permanently imprinted in the ball. For example, the same process that various golf ball manufacturers use to imprint their name and the ball type and number in the ball is used herein. For example, Titlelist has various types of balls including a Balata, a Professional, DT and other models. The ball also includes a single number, usually 1–8 which assists in identifying the players' ball from each other. In no way could this number be considered a unique identification code.

As is well know in the art, each golf ball has a precise mass which must be within a predetermined range as set by the USGA or the PGA. However, in the instant invention, each ball will have a precise mass that will be recorded for each unique identification number 32. This serves to authenticate that the ball is the special ball associated with the particular player and recorded at the time the player accepts the ball from the pro-shop. Thus, if a player were to purchase of series of gold balls 30, he would receive a separate identification number for each special ball 30.

At the time that the identification number 32 is recorded and the special ball(s) given to the player, the player's driver's license number and/or his social security number and picture identification would also be given to the on-site personnel at the pro shop 22. This would assist the on-site personnel in verifying the person's identity in the event the person was a winner.

It will, of course, be appreciated by the skilled artisan that while the inventor herein prefers the gold color, any color or combination of colors in any pattern is within the scope and spirit of this invention. In a contemplated embodiment of the golfing game 10 in accordance with this invention, the special ball 30 is a striped ball (not shown).

Figure 2:
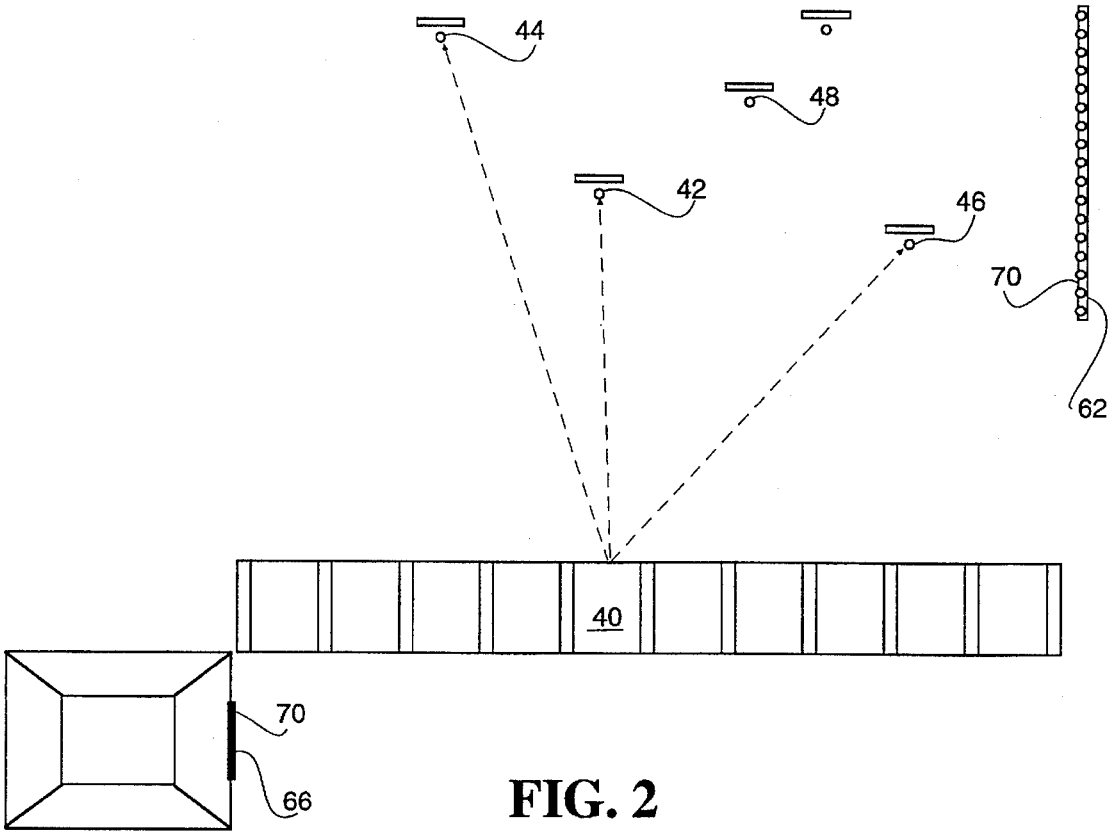
FIG. 2 is a top view of the driving range of FIG.1 illustrating an example of an electronic display system which used with a preferred embodiment of the golfing game in accordance with this invention.

As illustrated in FIG. 2, the player may have several options or combination of options in playing the game. The game maker or rule maker has the ability to alter the game or present the player with different game options. For example, the player in FIG. 2 starts at tee box 40 and sets his target for hole 42. As defined by the game illustrated in FIG. 2, the player's target is hole 42. The player must hit the special ball 30 so that it lands in hole 42. As will be appreciated, the game may be altered so that another hole is selected, for example hole 44. Alternatively, the game may be to complete a series of target in a particular order. For example, the game may be to complete holes 42, 44, 46 and 48 in that order. Alternatively, there may be no order or there may be a choice as to which targets will be selectively completed.

While the foregoing description has not previously included more that one gold ball 30. It will appreciated that any number of gold balls 30 may be used in conjunction with a game as set forth above. It may be desirable for a player to purchase 10 or more gold or special balls 30 at one time or only one depending on a player's level of interest and his ability.

Figure 3:
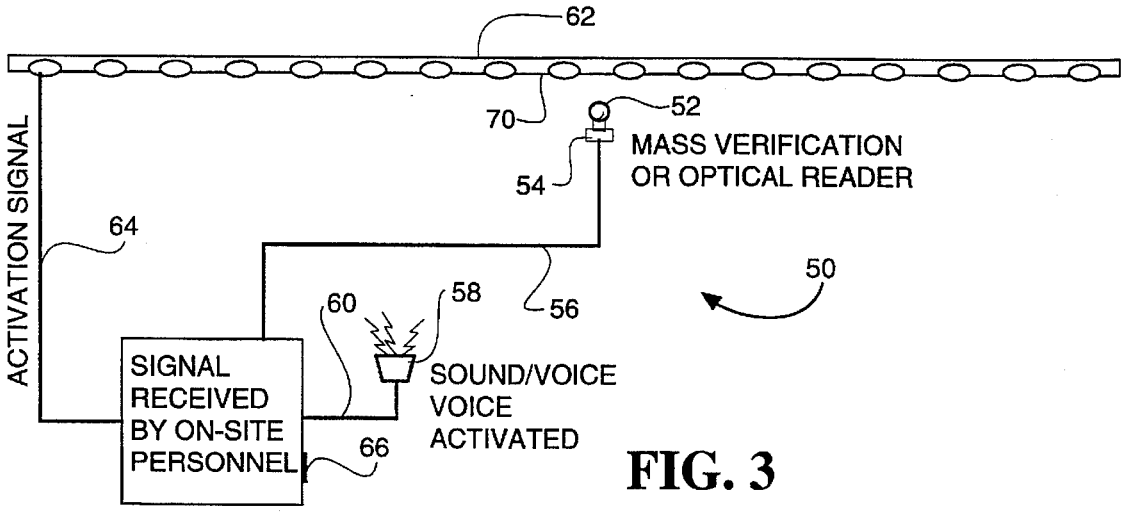
FIG. 3 is an schematic diagram of the notification system of the golfing game in accordance with the present invention.

With respect to FIG. 3 there is Shown a preferred embodiment of the notification system in accordance with this invention in schematic form, generally indicated by the numeral 50. The notification system includes a mass verification apparatus 52 and/or optical reader 54 for detecting when a ball has reached its target, a circuit 56 for notifying the pro shop on site personnel that the target has been reached, a sound notification device 58, a circuit 60 for activating the sound notification device 58, a visual notification device 62 and a circuit 64 for activating the notification device 60. Additionally, the visual notification system includes an electronic bulletin board 66 on the pro shop as additionally depicted in FIGS. 1 &2. This electronic bulletin board 66 may also be operated manually by changing the lettering on the outside (or inside) of the pro shop.

The mass verification device 52 weighs the ball and decides whether the mass fits within the range assigned to one of the special gold balls 30. If the ball reaching the target is not a special gold ball 30, an electronic signal is sent which notifies the on-site personnel at the pro-shop that a non-special ball has reached the target. The ball is then cleared from the target by either manual, mechanical or electronic means.

On the other hand, if the ball reaching the mass verification device is of the special gold ball variety then verification signal of a winner is sent to the on-site personnel. Once the mass verification device 52 signals the pro-shop, a signal activates the optical reader 54. The optical reader 54 reads the unique identification code on the ball and lets the pro shop know which player has made his goal. The pro shop can then verify that the player is, in fact, the correct player and was recorded as the possessor of the particular special ball 30 which is now determined to be the winner.

The mass verification device 52 and the optical reader 54 are connected to a computer device (not shown) as is conventional. The computer device may include a microprocessor which processes the signals received from the mass verification device 52 and the optical reader 54 and sends them to the on-site personnel at the pro-shop. As described above, the on-site personnel verify that the player winning is the properly recorded player for the relevant special gold ball 30.

The on-site personnel at the pro shop 22 after verifying a winner has been correctly recorded, then activate the sound notification device 58, and the visual notification device 62 through circuits 60 and 64. All play stops on the driving range 12 while the notification of a winner is announced. The visual notification device 62 includes a visual display 70. A notice to all at the range is then display on the display 70. As will be appreciated, the electronic bulletin board 66 also includes a display 70 which, of course, need not be electronic, but rather may be operated manually as set forth above.

Typically, the notice includes the player's name and the goal reached and his reward for the goal. This public display acts as a public acknowledgment and serves as an additional reward. This public acknowledgment is perhaps more valuable than any prize or other kind of reward a player might obtain. Of course, it is anticipated that this kind of reward will stimulate the player's work ethic toward practice and encourage additional practice for increased proficiency with the game in accordance with the instant invention as well as the game of golf.

While not shown, it is contemplated by the invention that additional and more elaborate sound notification devices are within the scope and spirit of the invention. In one embodiment, the sound notification device includes a fireworks display (not shown) which can be electronically activated upon verification by the on-site personnel.

Figure 4:
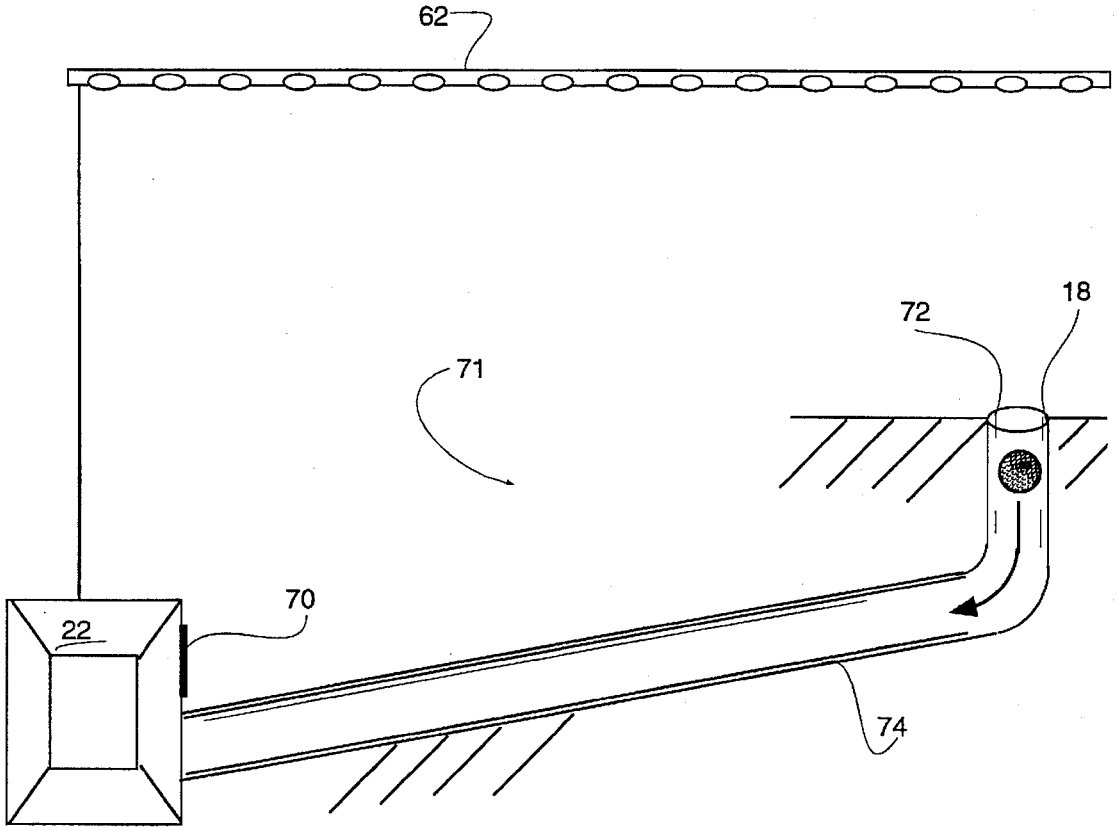
FIG. 4 is an alternative device for activating the notification system in accordance with this invention.

With respect to FIG. 4, there is shown a preferred manual device for return of a ball within the confines of a hole 18, designated generally a mechanical ball return 71. In one preferred embodiment each hole 18 generally and each specific hole 42–48 has such a mechanical ball return 71. The ball return 71 includes the hole 18 having an opening 72 where a ball enters. Upon entering the ball falls into a gravity chute 74, which enables the ball to roll all the way to the pro shop 22. Upon arriving at the pro shop 22, the ball is examined by the on-site personnel. If the ball is one of the special balls 30, the procedures described above are enacted and the proper verifications and notifications and rewards are distributed.

It will be appreciated by those skilled in the art of such mechanical devices as ball return 71 that a vacuum system could also be employed to prevent clogging of the gravity feed chute. Thus, a vacuum pump (not shown) would be attached to one end of the chute and the air evacuated from the chute 74

While the foregoing detailed description has described several embodiments of the golfing game in accordance with this invention, it is to be understood that the above description is illustrative only and not limiting of the disclosed invention. Particularly, the golfing game need not include a hole, but rather simply a target or predetermined destination. Additionally, the game need not include a single ball, multiple balls and multiple holes can be included, wherein the game may include successive accomplishment of various goals or competitive match play against one or more opponents. Additionally, while specific distances are set forth in the drawing, the golfing game in accordance with this invention need not be limited by any specific distance. In keeping with a game of skill, it is suggested by the disclosure of this invention that the reward be increased with the difficulty of accomplishing the goal set forth. However, since the reward system is not a specific limitation of the game, the game could not be said to be so limiting. It will be appreciated that the embodiments discussed above and the virtually infinite embodiments that are not mentioned could easily be within the scope and spirit of this invention. Thus, the invention is to be limited only by the claims as set forth below.

What is claimed is:

1. A golf game including a designated special golf ball and a driving-range, comprising the steps of:

providing a player ID;

measuring the exact mass of the special golf ball, the exact mass being a unique identification code for the special golf ball;

associating the player ID with the unique identification code for the special golf ball;

placing the special golf ball at a starting position a predetermined distance from a designated target;

striking the golf ball in the direction of the target;

designating an immediate winner for each special golf ball that reaches the target in one stroke using a notification system which is activated upon the target being reached;

verifying the player ID by measuring the exact mass of the special golf ball which has reached the target; and providing a reward upon the activation of the notification system, whereupon a notification system is activated upon reaching the target and the reward provided.

2. A golf game as set forth in claim 1 wherein the starting point is a driving range tee and the designated target is a golf hole.

3. A golf game as set forth in claim 2, wherein the notification system is automated.

4. A golf game as set forth in claim 3, wherein the notification system comprises an electronic device which upon being activated sounds an alarm and flashes and/or sounding a public notification.

5. A golf game as set forth in claim 1, wherein the steps further include issuing each contestant a game ball having a unique identification code, recording the unique identification code; and verifying the unique identification code with the records and then allowing the reward to be given.

6. A golf game as set forth in claim 5, wherein the unique identification code includes the ball having a unique alpha numeric code.

7. A golf game as set forth in claim 6, wherein the unique identification code further includes the golf ball being a gold color.

8. A golf game as set forth in claim 6, wherein the notification system includes an optical reader and wherein steps include the optical reader reading the unique alpha numeric code for verifying the winner and then activating the public notification system.

9. A golf game as set forth in claim 5, wherein the unique identification code includes the ball having a unique mass, at, slightly above the standard weight for golf balls, as assigned by the then current standards published by the United States Golf Association or its successor or successors, the game including a notification system which has a means of measuring the mass and verifying the unique weight of the winning ball and wherein the game includes the step of verifying the unique mass of the winning ball and activating the pubic notification system.

10. A golf game as set forth in claim 5, wherein the unique identification code includes the ball having a unique mass at slightly below the standard weight for golf balls, as assigned by the then current standards published by the United States Golf Association or its successor or successors, the game including a notification system which has a means of measuring the mass and verifying the unique weight of the winning ball and wherein the game includes the step of verifying the unique mass of the winning ball and activating the pubic notification system.

11. A golfing game comprising the steps of:

providing a player ID and a special golf ball having an exact mass which is used as a unique identification code for the special golf ball, a driving range having a starting point and a target, and a notification system and means for activating the notification system;

associating the player ID with the unique identification code for the special golf ball;

placing the special golf ball at the starting position a predetermined distance from the designated target;

striking the special golf ball in the direction of the target;

designating a winner for each golf ball that reaches the target in one stroke using the notification system which by activation means upon the target being reached;

verifying the winner by measuring the exact mass of the special golf ball to determine the identiciation code and comparing the identification code with the player ID; and providing a reward upon the activation of the notification system, whereby when the target is reached the notification system is activated and the reward provided.

12. A golfing game as set forth in claim 11, wherein the game includes an electronic notification system having a electronic display.

13. A golfing game as set forth in claim 12, wherein the notification system includes a verification system for verify that a valid special ball has reached the target.

14. A golfing game as set forth in claim 13, wherein the verification system is electronic and includes the game ball having electronically readable unique identification code and an optical reader for reading such a code and means for sending a verification signal.

15. A golfing game as set forth in claim 13, wherein the verification system is a manual system comprising a manual feed system wherein a ball is retrieved by a gravity chute after entering the target and wherein the special ball has a unique identification code which is manually verified.

* * * * *